United States Patent [19]

Nuber

[11] 3,930,383

[45] Jan. 6, 1976

[54] CIRCULAR KNITTING MACHINE

[75] Inventor: Otto Nuber, Rottenburg a.N., Germany

[73] Assignee: Firma Fouquet-Werk Frauz & Planck, Rottenburg a.N., Germany

[22] Filed: Aug. 30, 1972

[21] Appl. No.: 284,875

[30] Foreign Application Priority Data

Aug. 30, 1971 Germany ..... 2143285

[52] U.S. Cl. ..... 66/25; 66/115

[51] Int. Cl.[2].. D04B 9/06; D04B 9/36; D04B 15/68

[58] Field of Search ..... 66/50 R, 50 B, 36 A, 36 B, 66/75, 25, 115

[56] References Cited

UNITED STATES PATENTS

| | | | |
|---|---|---|---|
| 2,025,462 | 12/1935 | Lombardi | 66/50 R |
| 2,025,463 | 12/1935 | Lombardi | 66/50 B UX |
| 2,025,464 | 12/1935 | Lombardi | 66/50 R |
| 2,913,887 | 11/1959 | Ducharme | 66/50 B |
| 3,262,285 | 7/1966 | Beguin et al. | 66/50 R |
| 3,283,540 | 11/1966 | Levin | 66/36 A |
| 3,646,779 | 3/1972 | Nuber et al. | 66/25 |
| 3,678,710 | 7/1972 | Gostelow | 66/50 R X |
| 3,742,733 | 7/1973 | Paepke | 66/50 R |
| 3,747,371 | 7/1973 | Comas | 66/50 B |

FOREIGN PATENTS OR APPLICATIONS

| | | | |
|---|---|---|---|
| 1,546,919 | 10/1968 | France | 66/50 R |
| 1,373,258 | 8/1964 | France | 66/50 R |
| 543,276 | 2/1932 | Germany | 66/75 |
| 1,230,961 | 12/1966 | Germany | 66/50 B |
| 351,046 | 6/1931 | United Kingdom | 66/50 R |
| 366,325 | 2/1932 | United Kingdom | 66/50 B |
| 521,264 | 5/1940 | United Kingdom | 66/50 B |
| 996,291 | 6/1965 | United Kingdom | 66/50 B |
| 1,005,522 | 9/1965 | United Kingdom | 66/50 R |

*Primary Examiner*—Wm. Carter Reynolds
*Attorney, Agent, or Firm*—Flynn & Frishauf

[57] ABSTRACT

To permit selective needle projection, under control of a patterning arrangement, the needle jacks are made for rocking movement about an axis transverse to the direction of needle projection during knitting, and the camming system for the needle jacks is formed with two tracks, located one above the other (by a deeper cut, or camming elements of different heights) or, longitudinally staggered, one adjacent to the other, the cam tracks being arranged for selected projection of the needles to tuck or knit position; the needle jacks having either a butt projecting far enough to selectively engage either of the superimposed cam tracks, depending on the extent of rocking of the needle jack about the fulcrum, or the needle jack being formed with two butts, one on either side of the fulcrum, and selectively engaging the adjacent cam tracks, depending on the direction of rocking of the jack from a center position. The jack is retained in selected position with respect to the guide groove by a springy projection, laterally offset, and engaging a groove in the guide slot to prevent spurious rocking of the jack and escape from its controlled position. To control the needle jacks, selector jacks with respectively high and low break-out butts can be provided.

13 Claims, 15 Drawing Figures

Fig.1
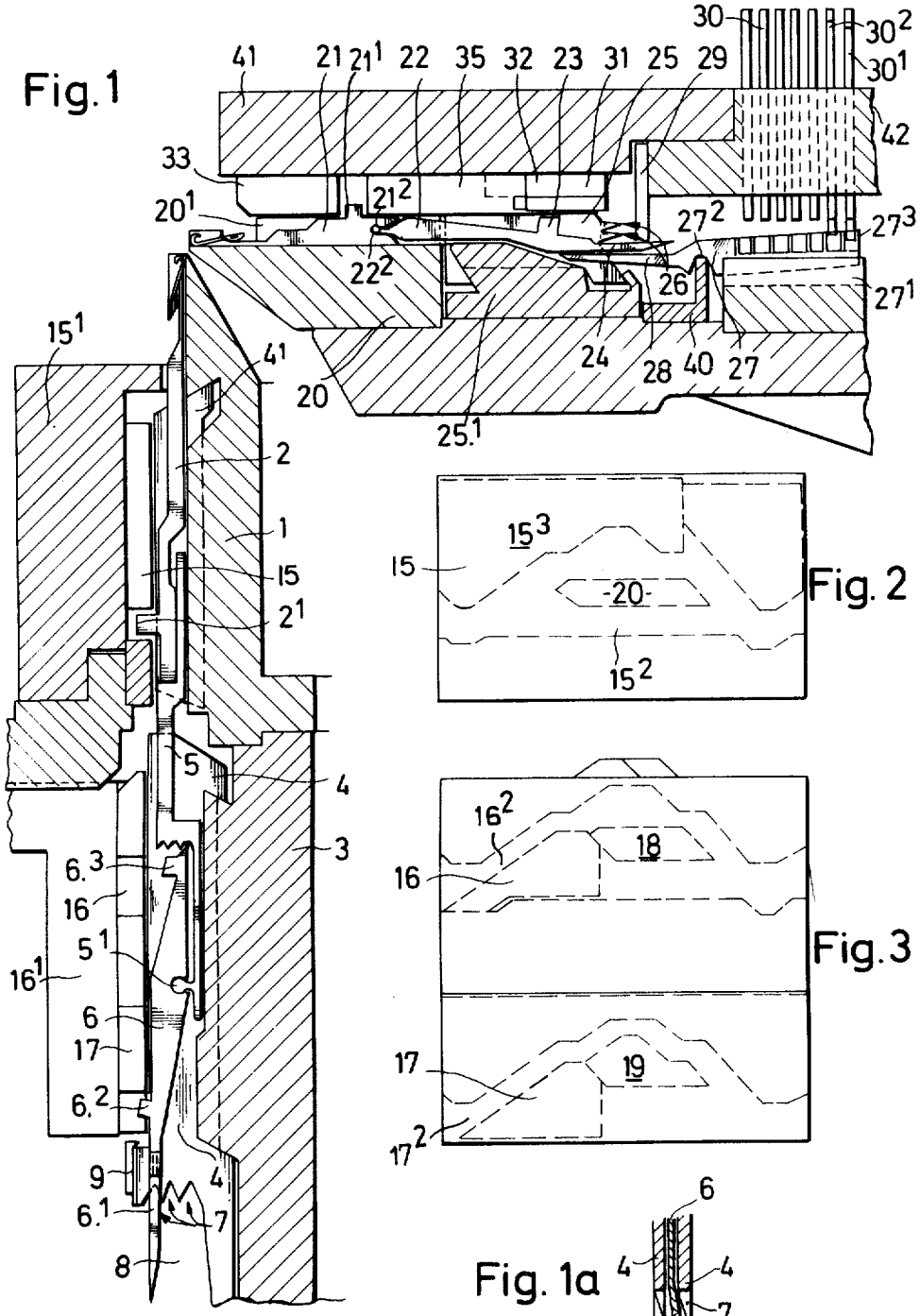
Fig. 2
Fig.3
Fig. 1a
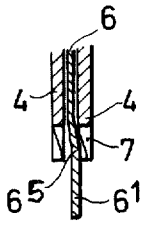

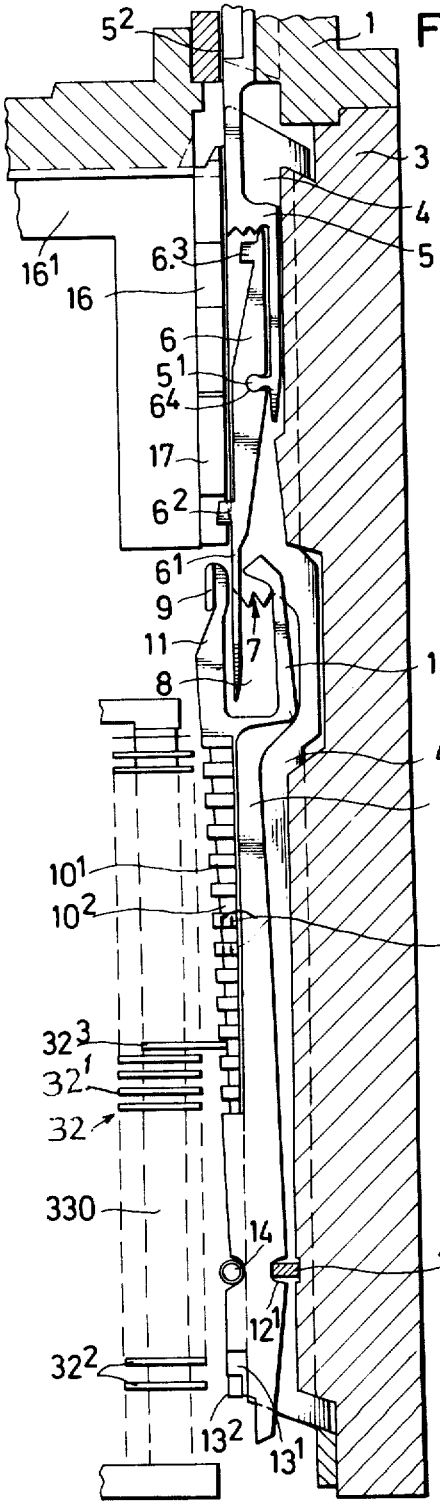
Fig. 4
Fig. 5
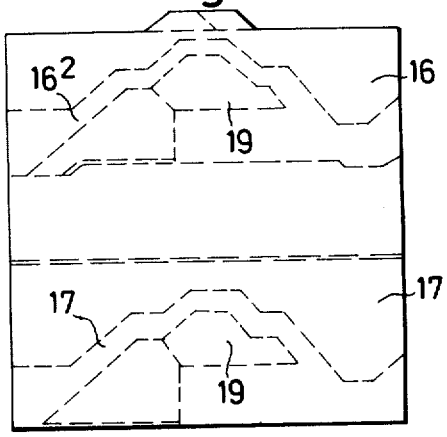
Fig. 6
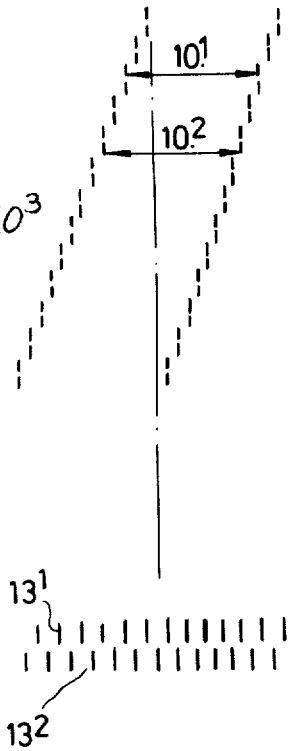

CIRCULAR KNITTING MACHINE

Cross reference to related applications: U.S. Ser. No. 246,651 filed Apr. 24, 1972.

The present invention relates to a method to make patterned rib knit goods on various types of circular knitting machines, in which the needles of the knitting machines are operated by associated cam races over needle operating jacks, and more particularly to a method for knitting, and a machine on which the knitting method can be carried out, which is easily controlled or programmed to permit pattern change.

Circular knitting machines having cylinder and dial needles are customarily provided with pattern controllers, such as Jacquard pattern controllers which control the various needles of the group (cylinder or dial) in accordance with the desired pattern. The needles are projected to tuck position, or knitting position, or not at all, in dependence on the pattern, as controlled by a pattern controller, or the needles may be controlled to project to the selected position by pattern wheels having high, or low pattern cam positions.

The patterning devices require a fair amount of space. Pattern wheels, particularly if substantial pattern repeats are to be controlled and the cut of the machine is fine, are subject to malfunction, so that their use is limited.

It is an object of the present invention to provide a method, and a knitting machine capable of carrying out the method in which additional bulky and space consuming pattern wheels or other pattern devices are not needed, and yet which permit control of a circular knitting machine simply and reliably, so that the knitting feeds can knit, on one or both needle groups, the customary types of knit goods such as plain stitches, tuck stitches, insert floats, skip stitches, in any one of the rows of the stitches.

SUBJECT MATTER OF THE PRESENT INVENTION

Briefly, both the cylinder, and the dial have a full complement of needles. The cam raceways for the butts, during knitting, remain unchanged. Needle jacks are distributed, in accordance with the pattern, to operate the needles, the needle jacks can be selectively positioned in one of three different positions, to be selectively controlled by correspondingly set cam raceways. Needle jacks set in a first position have their needle butts engaged in one cam raceway, which is so shaped that the needles are completely projected to knitting position to form stitches. In another position of the needle jacks, the needle butts engage a raceway which is so arranged that the associated needles are projected to tuck position, and in a third position of the needle jacks, no cam raceways are engaged by the butts so that the associated needles will remain in miss position.

In accordance with a feature of the invention, the cam elements of the knitting machine have two cam raceways, and the needle jacks are swingably located to rock about a pivot so that, selectively, butts on the needle jacks can selectively engage one, or the other of the cam raceways, or neither of the cam raceways. One of the cam raceways is shaped, when engaged, to project the needle fully to knitting position, the other cam raceway is shaped to project, when engaged by a butt, the associated needle to tuck position. The needle jacks are arranged, in accordance with the pattern, in such a manner that one needle butt may (as per pattern) engage the first raceway, the other needle butt may, according to pattern, engage the other raceway or, selectively, neither butt engages either raceway.

In accordance with another feature of the invention, needle jacks which are swingably mounted to rock over a pivot point may be so arranged that they have a single projecting butt which is placed to engage two different cam raceways. One of the cam raceways to be engaged by the single butt projects the needle fully, to knitting position, whereas the other cam raceway to be engaged by the single butt projects the needle only to tuck position. The needle jacks, again, are rocked about their pivot point to selectively engage the one, or the other cam raceway, or neither one of the cam raceways.

Interlock, eight lock, double pique fabric, as well as colored patterns, and any knit fabric having any miss, tuck, and knit stitch combinations may be made in accordance with features of the present invention and on apparatus thereof. Respectively set, or adjusted butt raceways cooperate with the needle jacks, controlled to be in the first or in the second position to either project the needles fully to knit position, or not at all, so that the needles will be in miss position. Cam raceways associated with different knitting feeds may be set to control the engaging butts to effect different needle movement, so that at one selector position the needle jacks can be placed in a position so that the butts will be engaged sequentially by cam raceways which effect, respectively, different needle projection from the same butt position.

The apparatus, and the method permit selective knitting of any desired type knitting fabric with simple cam race elements.

A circular knitting machine, in accordance with a feature of the invention, is so arranged that the knitting needle may be selectively projected by a needle jack which can be placed, selectively, in one of three adjustable positions the needle jacks being secured in position by, for example, a springy projection engaging grooves, or slipping into a notch.

In a preferred form, the needle jacks of at least one group, particularly the cylinder needles, are so arranged that they can pivot about a fulcrum point, the needle jack being formed with needle butts located, preferably symmetrically, at both sides of the fulcrum point. Each one of the projecting needle butts cooperates with a cam race, projection of the needle butt being controlled by a pattern arrangement, such as a Jacquard pattern controller. The cam races cooperating with the respectively located needle butts then effect projection of the associated needle to the selected needle position.

The dial group is preferably so arranged that the needle jack is formed with a single butt, which may project for a greater distance than the butts of the cylinder jacks, and the dial cam structure is so arranged that the cam race has two cam raceways at selectively different heights, so that, when the jack butt is fully projected, one cam race is engaged whereas, when the jack butt is projected only for a portion of its maximum possible distance, say half, the other cam race is engaged, so that the needle is projected in accordance with the respectively engaged cam race. In a third position, the butt is entirely withdrawn and the needle will miss. In a preferred embodiment, the needle jacks are formed with a thin projecting tail which is slightly laterally offset, or bent, to resiliently engage notches, or grooves formed in an associated jack guide slot, so that the projecting tail can slide longitudinally, but is resiliently restrained from lateral swinging, absent a specific control force acting thereon.

The needle jacks, when in a first or second projecting position engage the respective cam races to project to tuck or knit position; in the third position the butts remain out of engagement with the cam races, so that the associated needles remain in miss position. In a preferred form, the needle jacks and butts are so dimensioned that the butts can be depressed to be flush with, or below the surface of the cylinder and needle guide slots.

In one form, the cam races for the machine can be so selected that all needles associated with needle jacks placed in first position are completely projected, that is, are projected to knit position, whereas the needles having their butts placed in a second position are projected only to tuck position. It is, of course, also possible to select the adjustment of the cam raceways such that the needles are completely projected to knit position, or only projected to tuck position regardless of the position setting of the needle jacks, for example for sequential feeds. This provides for a wide range of patterning. The machine, therefore, preferably is so made that the cam raceways are adjustable, or interchangeable on the machine. The needle jacks themselves are placed in one of their three possible positions by means of selector jacks formed with high and low selector butts. The needle jacks for the dial, specifically, can be set by swingably or rockably located selector butts which are arranged to engage beneath the projecting tail of the associated needle jack. For the cylinder, particularly, the needle selector preferably has two elements, such as forked elements engaging the needle jacks and being selectively placed in position by means of a needle selector element.

The invention will be described by way of example with reference to the accompanying drawings, wherein:

FIG. 1 illustrates, highly schematically, a portion of a circular knitting machine, in radial section, through the needle cylinder and through the dial, and illustrating the selector elements and the needles in the needle guide slots;

FIG. 1*a* is a fragmentary view illustrating resilient retention of the needle jacks, for the cylinder needles, taken transversely to the view of FIG. 1;

FIG. 2 is a schematic view of the cam race for the cylinder needles of FIG. 1, in developed plan view;

FIG. 3 is a schematic, developed plan view of the cam race for the needle jacks to select the cylinder needles;

FIG. 4 is a vertical radial cross-section through the selector cylinder, illustrating selection by the selector jacks, and, schematically, the selector apparatus;

FIG. 5 is a schematic, developed view of the cam race for the needle jacks to select cylinder needles, illustrating a different embodiment from that of FIG. 3;

FIG. 6 is a schematic representation of the arrangement of the selector butts in the respective guide slots of the selector jack cylinder of FIG. 4, as a developed portion of the cylinder;

Figure 9:
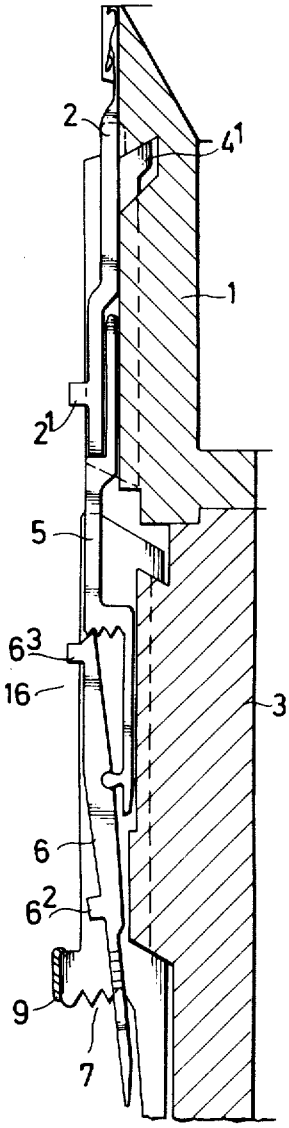
FIGS. 7, 8 and 9 are radial cross-sectional views of the cylinder, illustrating placement of the needle in three, selectively different positions, in accordance with the positioning of the needle jacks.

The cylinder 1 rotates, as well known, and is formed with vertical needle guide slots, in each of which a flat, strip-like cylinder needle 2 having a shank end portion is slidably located. A coaxial needle jack cylinder 3 is fixed to the needle cylinder 1, likewise formed with vertical guide slots which are aligned with the guide slots of the needle cylinder 1. The guide slots of the jack cylinder 3 are formed by inserted guide liners 4 (FIG. 1*a*), between which the guide slot itself is formed. The projecting jack for the needle itself is a two-element device, having elements 5, 6 guided in the slot formed by guide inserts, which further guide a selector jack 10. Needle cylinder 1 likewise is formed with guide slots liners $4^1$.

Figure 8:
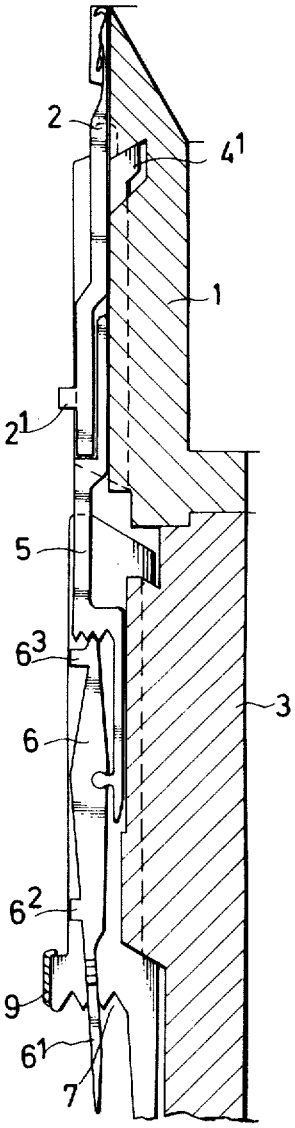
Figure 7:
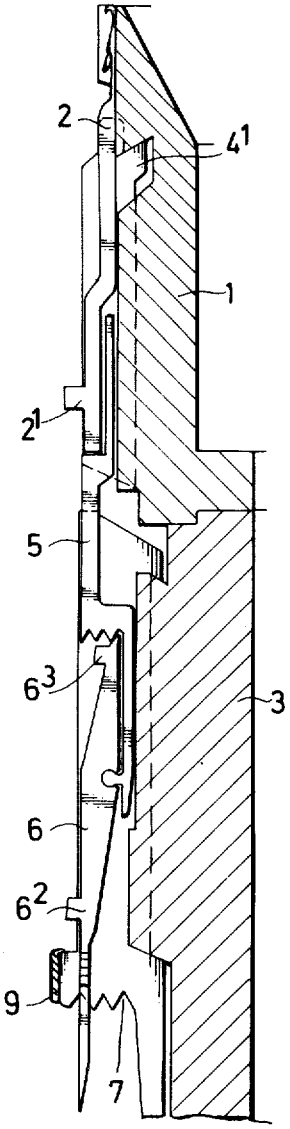

Each needle selection device has a needle push element 5 having a ball-shaped or flat, essentially circular disk-shaped projection $5^1$, which cooperates with the associated cylinder needle 2 by means of a shoulder $5^2$. The other element of the needle projecting device 6 has a projecting lower end, or tail $6^1$, and a pair of projecting jack butts $6^2$ and $6^3$. Element 6 further is formed with a circular notch, or cut $6^4$, located roughly in the middle between the two butts $6^2$ and $6^3$. The essentially circular disk-shaped projection 5 fits into the opening $6^4$, to form a fulcrum over which the element 6 can rock, or tilt, or tip, as seen in FIGS. 7, 8 and 9, the disk-shaped projection engaging in the opening $6^4$ further forming an operative interconnection between the needle push element 5 and the actual selector element 6 which, together, form the needle jack 5, 6.

The narrow tail-like extensions $6^1$ of the elements 6 are slightly, laterally offset or bent as seen at $6^5$ (FIG. 1*a*), to resiliently engage notches 7 formed in an adjacent guide liner 4, and to provide discrete positions and to prevent spurious, uncontrolled rocking of the element 6 about the disk-shaped projection $5^1$ of the associated element 5. The guide liners 4 are relieved, as seen at 8, in the region below the notches 7 in order to permit ready movement of the extension tail $6^1$, as required to shift the position of element 6.

The tail-like projections $6^1$ of the elements 6 extend between two tines which form the upper end of the selector jacks 10 (FIG. 4). The tines have slightly thickened head ends directed towards the tail $6^1$ to provide an operative coupling between the respective associated element 6 and the selector jack 10. A holding ring 9 (FIG. 1) surrounds the guide slot liners 4, located about the relief 8, in order to secure the selector jacks 10 and the elements 6 against removal from the respective guide slots.

The selector jacks 10 (FIG. 4) are formed with a relief $12^1$ adjacent their lower ends, the relief fitting in a projection 12 formed on a side of an associated guide slot 4. A circumferential spring 14 surrounds all of the selector jacks 10 to secure the selector jacks in their guide slots against falling out of the guide slots, the projections 12 forming a holding point to prevent vertical shifting of the selector jacks, so that the selector jacks 10 may only swing, or rock vertically about the projections 12 as a fulcrum for the rocking movement.

Selector jacks 10 are formed, circumferentially outside with respect to the machine, with high (long) and low (short) selector butts $10^1$ and $10^2$, respectively, as seen in FIG. 4, the long and short butts alternating . In the example shown in the drawings, selector butts $10^1$ and $10^2$ of the respective selector jacks are so broken out, or removed, that selector jacks 10 with the long, and short butts $10^1$ and $10^2$, respectively, are placed in staggered sequence, adjacent each other, on the circumference of the jack cylinder 3, as schematically indicated in the fragmentary developed view of the jack cylinder in FIG. 6, where the butts to control needles for one feed are, schematically, illustrated.

In addition to the control butts $10^1$, $10^2$, the selector jacks 10 are formed at their lower end with a pair of eliminator or blanking butts $13^1$, $13^2$ which, in the example shown, are so broken out that every other selector jack 10 has a projecting blanking butt $13^1$, or $13^2$ in staggered sequence — see FIG. 6, bottom portion.

The selector jacks 10 are rocked by Jacquard drums, in well known manner, as, for example described in detail in DOUBLE KNIT FABRIC MANUAL, published by National Knitted Outerwear Association, New York, particularly pages 45–52; see also German Pat. No. 1,147,706. The literature reference referred to also describes further details of circular knitting machines for use with the apparatus of the present invention.

The Jacquard selector device, as described in the literature reference, has a stack of superimposed selector cams 32, $32^2$, $32^3$, etc., which are arranged to rock or swing about a vertical axis 330, and which can be selected by a Jacquard selector drum, not shown, (see literature reference), in accordance with a selected pattern. FIG. 4 illustrates selector cam $32^1$ in rest position, in which neither of the selector butts $10^1$ or $10^2$ of the selector jacks 10 areinfluenced; whereas the selector cams $32^3$ are shown in projected position in which the selector jacks 10, when contacted by the cams, will be rocked. The selector cams $32^2$ are utilized to control the blanking or cancelling butts $13^1$, $13^2$.

If a cam $32^3$, set into its effective or engaging position, engages a butt $10^1$ or $10^2$ of the selector jacks 10, then it will be rocked from the position shown in FIG. 4, about the fulcrum projection 12. The extent of projection depends upon the engagement of the selector jack $32^3$ by either a long butt $10^1$, or by a short butt $10^2$. If engagement is by a long butt, rocking of the selector jack 10 will be over a greater angle, so that the tail portion $6^1$, surrounded by the two tines of the selector jack will be carried over to the notch 7 is farthest at the right (FIG. 4); if the cam $32^3$ meets a short butt $10^2$, then the selector jack 10 is rocked only over a smaller angle which carries the tail $6^1$ of the element 6 to the central notch 7. The selector jacks 10, rocked in their guide grooves or slots can be returned by engagement of the cancelling or blanking cam $32^2$, likewise movably located on axis 33, with the blanking or cancelling butts $31^1$, $31^2$, respectively to be returned to a start or base position.

Selection of specific selector jacks 10, and their movement, from a base position, as well as return to the base position can be controlled by other apparatus, or other selection devices, as known in the art.

The cylinder 1 is surrounded by a cylinder camming system structure $15^1$, carrying a cylinder needle camming system 15 at the inner side thereof, the structure being fixed to the frame of the machine. FIG. 2 illustrates a developed view of the camming system. The cylinder needle camming system has a circumferential race $15^2$, corresponding to needle miss position, and a needle track or raceway $15^3$, which is engaged by needle butts $2^1$ projecting from the cylinder needles 2. Cylinder needles 2 which are not knitting are held by cam element 20 in the circumferential track $15^2$; cylinder needles 2 which are projected — as will be described below — to tuck position or to knitting position are returned back to withdrawn or retracted position after the knitting loops have been formed.

The jack cylinder 3 is surrounded at the outside by a jack camming system structure $16^1$, having, at the inside, two camming systems 16 and 17 formed therein. FIGS. 3 and 5 illustrate, in schematic, developed representation, different embodiments of examples of camming systems for any one knitting feed.

Camming system 16, and camming system 17 (FIG. 3) each have a cam track $16^2$, $17^2$, respectively. The upper camming track $16^2$ cooperates with the upper needle jack butts $6^3$. The lower camming track or raceway $17^2$ cooperates with the lower needle jack butts $6^2$. The needle jack camming systems 16, 17 have cam elements 18, 19 which can be selectively replaced, so that the camming system of FIG. 5 or FIG. 3 can be arranged in the camming system structure. The camming system structure can also be so arranged that the cam elements 18, 19 are formed as selectively positionable elements to define the cam tracks, schematically shown in FIGS. 3, 5, respectively, in dependence on the position of a respective camming element in the system, as known in the art.

Operation: The selector jacks 10 are placed in their respective positions, according to pattern, by cooperation of the pattern levers, or selector cams 32 with the respective selector butts $10^1$, $10^2$, that is, by cooperation of those pattern levers $32^3$ which project. The adjustment of the selector jacks 10 thus will be in accordance with three discrete positions, which correspond to the positions of the respectively associated elements 6. The needle jack elements are held in their respective deflected, or non-deflected position by the springy projections of $6^1$ engaging in the respective notches 7. The projection $6^1$ is laterally, resiliently deflectable.

Needle jacks 6, which, due to the selection of the selector jacks $10^1$, are placed in the furthest inwardly located groove 7 are rocked such that the upper needle selector butt $6^3$ engages in cam race $16^2$ of the cam system 16, as illustrated in FIG. 9 (from which the cam raceways have been omitted). If the selector butt which is engaged by the pattern levers 9 is a short butt, then the needle jack elements 6 are so deflected that the central notch or groove 7, is engaged by the projecting tail $6^1$ of the needle jack, thus maintaining needle jack 6 in the position in which both of the butts $6^2$ and $6^3$ are within the guide slots of the jacks, as seen in FIG. 8. Thus neither of the butts engage any one of the cam races $16^2$ nor $17^2$, and the needle jacks are not carried along by the camming system.

Those needle jacks 6 which are not deflected at all by engagement of the associated selector jacks 10 retain the extending portion $6^1$ in the groove 7 which is farthest at the outside (FIG. 7) so that the lower needle jack $6^2$ can engage in the cam race $17^2$ of the cam system 17.

In the embodiment illustrated, the lower cam raceway of FIG. 3 is set to drive the needles fully, that is, to knitting position, the upper cam system 16 being set to drive the needle to tuck position. The cylinder needles 2 are thus projected accordingly, that is, those cylinder needles which are coupled with the needle push or jack element 5 in which the butts $6^3$ engage the cam race $16^2$ the upper raceway 16 are projected to tuck position (FIG. 9) whereas those needles in which the needle jack element 6 is placed as illustrated in FIG. 7 are fully projected to knitting position. The remaining cylinder needles, whose associated needle jacks 6 are located as illustrated in FIG. 8 remain in miss position, that is, will not be projected at all.

The needles which are projected, either fully or partially, are brought back to rest position by cooperation of the cylinder needle cam system 15 with the cylinder needle butts $2^1$, as well known. The elements 6 are controlled to a controlled position by engagement of the cancelling butts $13^1$, $13^2$ with the respective cancelling cams $32^2$ FIG. 4; they may be returned by a return cam engaging the lower end, as well known.

The description so far, has been confined to the cylinder and selection of the cylinder needles, Dial needles, likewise, can be selected for projection through different distances.

Referring again to FIG. 1, the dial 20 is formed with guide elements $20^1$ in which dial needles 21 are radially slideable. Each dial needle 21 is formed with an essentially circular notch or opening $21^2$ in which a disc-shaped circular projection 22 of a dial needle jack 22 can fit. Thus, dial needle jack 22 is in operative engagement with the needle 20. The needle jacks 22 are guided between guide bars 25 of the inner dial disc $25^1$. They are formed with a single projecting butt 23, and with a rearward, fairly narrow push projection 24. The jacks 22 are tiltable about the disc projection $22^2$.

Figure 10:
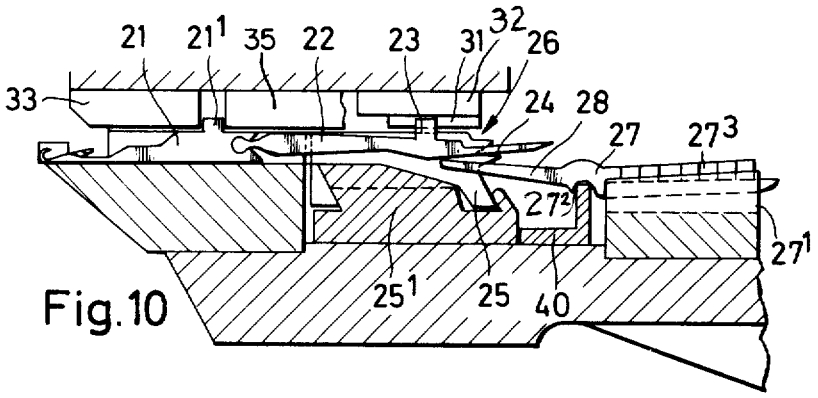
FIGS. 10 and 11 are radial, sectional views illustrating the dial portion of a circular knitting machine and adjustment of the needle jacks for the dial needle, the needle jacks being half lifted (FIG. 10) and fully lifted (FIG. 11) for respective selection.
Figure 11:
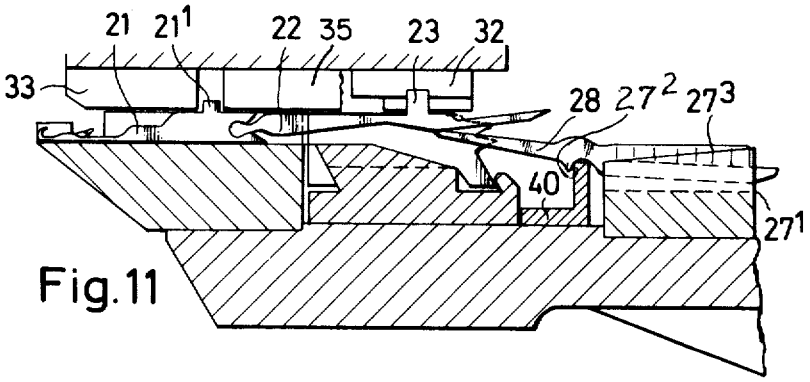

The guide bars 25, as seen in FIGS. 1, 10 and 11, are formed with locating notches 26, in which the jack extensions 24 of the jacks 22 can resiliently engage. These jack extensions are slightly laterally offset to resiliently snap into the grooves 26. The principle is similar to the tail end $6^1$ of the cylinder needle jacks 6 and their engagement into the grooves 7.

The selector jacks which control the needle jacks 22 are of the lever type shown at 27. They are laterally guided between guide notches, or guide liners $27^1$. The selector jacks 27 are formed with a notch $27^2$ which fits over a ring-shaped bearing ridge 40, so that the selector jacks 27 can tilt over, or rock about ridge 40 as a fulcrum. The back ends of the selector jacks 27 are formed with selector butts $27^3$ which can be broken out, according to a pattern. The forward part of the selector jack has a projecting extension 28, which is narrow, and engages beneath the narrow rear portion 24 of the associated needle jack 22. Thus, when selector jacks 27 are rocked about fulcrum of ring 40, the associated needle jack 22 is likewise rocked about the circular head $22^2$.

The dial cam system is formed as a disk 41. At its lower side, facing the dial needles 21, the cam system 33 itself is located, consisting of cam parts (see FIG. 12) $33^1$, 34, 35, 36. The cam elements 34, 35, 36 prevent escape of dial needles 21 and of needle jacks 22 from the associated cam grooves.

Figure 12:
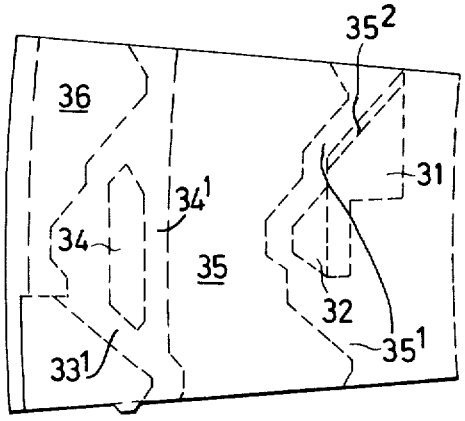
FIG. 12 is a schematic bottom view of the dial cam races, for one knitting feed, illustrating selection of the dial needles.

Each needle 21 is formed with an upwardly projecting needle butt $21^1$ which fits into the associated needle cam race $33^1$ (FIG. 12 illustrates this for 1 knitting feed) and which permits determination of the loop density.

The dial cam disk 41 is, adjacent to the dial cam race 33, formed with a needle jack cam system. The needle jack cam system has a raising cam 32 and a re-set cam part 31. Raising cam 32 and re-set cam 31, conjointly with cam part 35 define a cam race $35^1$ and $35^2$ respectively. Each needle jack 22 has a single, projecting butt 23 which co-operates with the needle jack cam race $35^1$, $35^2$, as will be explained in detail below.

Radially inwardly with respect to the dial camming system as illustrated in FIG. 12, a jack guide element 29 (FIG. 1) is fixedly located. Element 29 acts from above on the jack part 24 so that all needle jacks 22 are moved into the lowest position (FIG. 1) in which all the jack butts are depressed beneath or level with the associated guide slot. Likewise, the selector jacks 27 are placed into their selection position.

A carrier ring 42, fixed on the frame of the machine is located in the region above the selector butts $27^3$ of the selector jacks 27. Carrier ring 42 carries selector plates 30 which are slideable thereon (see FIG. 1) and which can be moved from the non-effective position as shown in FIG. 1 into a second, effective position, as illustrated for the slider $30^1$, in which they engage the selector butts $27^3$ of the selector jacks 27. Selector plates 30 can be fixed in effective, as well as ineffective (disengaged) position after having been set in accordance with the pattern.

The selector plates 30 can be placed into two operative conditions; besides the position indicated for plate $30^1$, that is, the lowest position, a third position shown in FIG. 1 at $30^2$ is possible. In this third position, which is approximately midway between fully projected position ($30^1$) and retracted position, they cause only limited rocking of the selector jack 27.

The cam races $35^1$ and $35^2$ (FIG. 12) have different depths; they are formed by cams which project from the face of the dial cam system carrier by different distances. The cam race $35^1$ is deep in the dial cam structure. The cam element 35 has approximately the same thickness as cam element 33.- see FIGS. 10 and 11 - and cam element 32 extends from the base of the carrier of the dial cam system. Placed next to cam element 32 and projecting downwardly is cam element 31, so that butts which are lifted only part way, that is, to the second position, will not engage behind cam element 32 but will be engaged only by cam element 31.

OPERATION

Needle jacks 22 which are not affected by the selector jacks 27 cooperating with the selector plates 20 remain in the non-engaging, ineffective selection position illustrated in FIG. 1. The extending jack portion 28 is engaged in the lowest engaging notch 26. The butts 23 of those jacks 22, which are not selected, do not engage either of the cam races $35^1$ nor $35^2$, but rather are withdrawn between the guide elements 25. Thus, the associated dial needles 21 are not projected, and these needles are therefore in miss position.

Needle jacks 22 which have the associated selector jacks 27 engaged by selector plates in the position indicated in FIG. 1 at 30², that is, in the intermediate position, will be lifted to such an extent that the narrow jack part 24 will engage in the central engagement notch 26, so that the associated selector butts 23 will be engaged by the cam race 35². In cam race 35², they awill be engaged only by the lower cam element 31 (see FIG. 12), so that the dial needles will be projected by a half distance, that is, to tuck position, see FIG. 10.

Those needle jacks 22 having their selector butts 27 engaged by selector plates 30 which are in the completely projected position indicated in FIG. 1 at 30¹, will lift the rear portion 24 of the jack to the upper notch 26, as seen in FIG. 11. Butt 23 of such a jack 22 will then engage in cam race 35¹. The entire cam element 32 will act on these butts so that the associated dial needle 21 is fully projected to knitting position, to knit loops.

The needles, whether fully or half projected, are withdrawn by engagement of dial cam 33, to withdraw the needles on engagement of needle butts 21¹ in cam the race 33¹ of cam 33. The cam race additionally is formed with a raceway 34¹ for, formed by cam element 34 those needles which have not been projected, that is, to retain non-projected needles in their miss position.

The selector jacks 30 can be controlled by any known Jacquard patterning device which places the selector jacks 30, automatically, in their position in accordance with pattern. The patterning device may be formed so as to have only two positions - withdrawn or projected. Selector jacks to beused with such a selection device will then be formed with butts which can be either completely broken away, or only half broken away, similar to the butts 10¹, 10², respectively of the cylinder selector jacks.

Each one of the needles, 2, or 21, that is, the cylinder and dial needles respectively, can thereby, automatically, be introduced into the respective cam race for any desired knitting step, that is, knit, tuck, or miss, without requiring any associated apparatus or device, by merely appropriately setting, or assembling the cam elements which form the cam races. This is made possible by the needle selector jacks 5, 6, in the cylinder, the needle jacks 22 in the dial 41, and the respectively associated patterning devices, known by themselves, for the cylinder needles 2 and dial needles 21, that is, the associated selector jacks 10, 27, respectively.

It is possible to make a number of different types of knit fabric without needle change, or re-programming of an entire knitting machine: all single or double-faced ribbed fabrics, such as for example 1:1, or 2:2 ribbed fabrics, other types of ribbed fabrics, interlock, eight-lock, and pique fabric, tuck stitch patterns, Jacquard, knopped patterns, tuck blister patterns, and colored patterns of any type, both single sided as well as double sided.

KNITTING METHODS to knit ribbed goods of all types, both the cylinder 1 and the dial will have a full complement of needles therein. All of the cam system 15, 16, 17 of the cylinder (FIGS. 2, 3) and 31, 32 as well as 33¹ of the dial (FIG. 12) are set as shown. Needles associated with needle jacks 6 which have their lower butt 6² engaged in the associated cam race are completely projected to knitting position, whereas those needle jacks 6 in which the upper butt 6³ is engaged in the associated cam race are projected only partially to form tuck stitches. The cylinder needles which are not to knit are controlled to remain in miss position by retaining the jack part 6 in central position with both butts 6² and 6³ even with or depressed within their guide grooves. Dial needles 21 which have their associated jacks placed in the position of FIG. 11, that is, completely lifted, are projected to knitting position, whereas those dial needles 21 having associated needle jacks 22 lifted only half maximum lift distance are projected to tuck position. The remaining dial needles, the associated needle jacks of which remain in the lower position (FIG. 1) remain in miss position, and are secured therein without being projected. The cam races are shown in FIGS. 2, 3 and 12 respectively.

To make eight lock, interlock, and pique fabric, and without requiring any re-programming of the pattern selector, or of the associated selector jacks, it is only necessary to replace in the cam system 16 the cam element 18 by another element similar to cam element 19, so that, without requiring any change in the selector jack setting, the needles will be fully projected regardless of whether the needle jack element 6 is in the position shown in FIGS. 1 and 7, or in the position shown in FIG. 9. Thus, those needle jacks 6 which engage with their upper butt 6³ in the upper cam system 16 control the needles for full projection as well (see FIG. 5), thus causing the associated cylinder needles 2 to form loops at their projected knitting position. As noted, rather than replacing the cam element 18 (FIG. 3) of the camming system 16 with a cam element 19 (FIG. 5) a movable cam can be provided to form the appropriate raceways.

Needle selection can be simplified when making the referred to fabrics by controlling every other needle selector 6, each with a butt 6² or 6³, alternately, to engage the upper or the lower cam race 16, 17, the needles themselves being selectable in two knitting feeds, as known in the manufacture of interlock or full body fabric.

Figure 13:
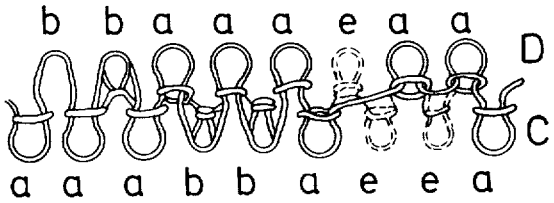
FIG. 13 illustrates a stitch pattern of a fabric made on the machine of FIG. 1, the stitch pattern hanging on the dial needles of the machine, with the dial needles themselves having been omitted.
Figure 14:
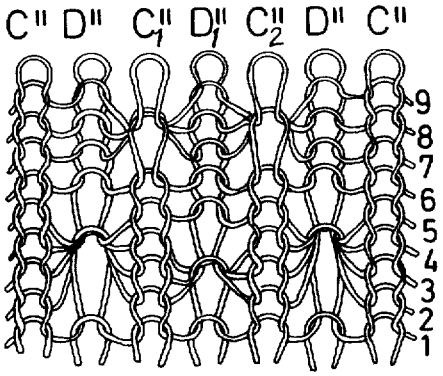
FIG. 14 is a schematic representation of the loops of a fabric made in accordance with the method, on the machine of FIG. 1, having a double-sided pique pattern.

FIGS. 13 and 14 illustrate examples of different types of loop formations which can be obtained at any knitting feed by selective adjustment of the needle jacks 6 and 22. FIG. 13 illustrates the cylinder needle row C and a dial needle row at D; FIG. 14 illustrates the ribs formed by these needles with these same letters with double prime notation.

The fabric of FIG. 13 is made of loops formed at a by needles which are fully projected to knitting position, whereas tuck stitches, formed by half-projected needles are indicated at *b*. The loops indicated at e are derived from the previously knit row of loops and hang on needles which are not knitting. The needles themselves are not shown.

FIG. 14 illustrates a double-sided Jacquard relief or blister pattern (also termed knop) having 7 vertically extending ribs, or wales, and 9 courses of loops.

Course 1 is formed by all cylinder and dial needles 2, 21. All jacks, 6, 22, respectively control the associated needles 2, 21 for complete projection to knitting position.

Courses 2 and 3 show that all dial needles knit ribs (D''); all cylinder needles knit full stitches (C''). Course 4 shows that ribs D'' have tuck stitches whereasthe rib $D''_1$ has a full stitch. Cylinder needles C'' form full loops.

The next adjacent courses, 5, 6, form full stitches on both needle groups, that is, dial and cylinder; in the subsequent courses 7 and 8, the central ribs $C''_1$ and $C''_2$ show tuck stitches; in all other ribs, full stitches are formed as illustrated at C'', B'' and $D''_1$.

Course 9 illustrates that the tuck stitches on the cylinder needles (C'') are knit into the full loops of course 9, thus forming the raised, relief or blister fabric on the cylinder, as previously referred to.

Double-sided blister fabric can be made without changing cam races, and merely by suitable pattern selection acting on the needle jacks 6, 22. The patterns which can be made are not restricted to the examples of FIGS. 13 and 14 and as described, these examples are given merely as an illustration.

Needle selection may be carried out practically for all types of knit goods to be made without changing the patterning, and with or without switching of the cam races, or cam raceways, and without placing new or different length needles in the machine, so that the manufacture of the circular knitting machine is simplified, the number of knitting feeds can be increased, and changes from one type of knit fabric to another can be easily accomplished without complete pattern changing, changing of pattern selector drums, or change of needle selector butts on the knitting machines. For example, if the cam system of FIG. 5 is utilized for the cylinder needles for the selected knitting feed, it is possible to utilize a single selector as a controller for two knitting feeds, i.e., a single selection position for the needles (e.g., a Jacquard control drum), for the needles to knit at two knitting feeds.

The needle jacks 6 are preferably formed with a pointed forward end engageable in a serrated rearward end of the associated needle part 5 (see FIG. 1) to additionally lock the needle jack part 6 in the selected, rocked position as determined by excursion of the associated selector jack 10.

Various changes and modifications may be made within the inventive concept.

If desired, the needles can be controlled not only to project to tuck and knit position, but may also be controlled, by suitably shaped cam races, to project to transfer position. In such case, not 3 but 4 notches 7, or 26, respectively, are provided and engaged by the rearward projections $6^1$, or 24 of the needle jacks. The engagement position of one of the butts, for example in accordance with FIGS. 7–9 can be additionally modified by forming one of the cam races, for example of the cam system 16 (FIG. 3) of double height, as explained in connection with a cam 31, 32 and cam tracks $35^1$, $35^2$, FIG. 12. Thus, the camming system of FIG. 12 and FIG. 3 (or 5, respectively) can be combined, the needle jack elements then being formed with one or two projecting butts $6^2$, $6^3$, which have the projection extent of butt 23 (FIGS. 10, 11). The depth of engagement, as well as engagement of the respective butt then can be controlled by a selector similar to that explained in connection with FIG. 4, having projecting elements 32 which can project for different distances, for example to engage either the high, or low butts $10^1$, $10^2$ of the selector jack 10 to a different extent, to thus place the butt which is extended to either one of the superimposed raceways of the camming system. Theoretically, five different positions can be controlled, by forming both of the camming systems 16, 17, (FIG. 3) of double height, and similarly controlling the rocking movement of the needle jack element 6 to assume five different positions.

A similar modification can be made with respect to the dial where the double-height cam discussed in connection with FIGS. 1, 10 and 11, can be duplicated as discussed in detail with respect to the cylinder needle projection in connection with FIGS. 3, 5 and 7–9.

The jacks 10 (FIG. 4) can already be made with high and low butts; or the butts can be made with two or more break-off lines $10^3$ (FIG. 4) for either shortening a butt, by breaking away a portion, e.g., half, or breaking it off entirely.

The detailed specification is directed to that portion of the machine in which the apparatus of the present invention is incorporated and with which the method of the present invention is useful. For a complete discussion of knitting machines, reference may be had to "Double Knit Fabric Manual", 1961, "Knitting Dictionary", 1966, "Knitting Encyclopedia, " 1972, published by the National Knitted Outerwear Association; "Technologie der Rundstrickerei" by Albert Diebler, Konradin-Verlag, Stuttgart, particularly vols. 9, 10 and 11; "MELLIAND TEXTILBERICHTE", Heidelberg, particularly Vol. 42, issue 12, 1961, pages 1363–1370; the various operating and programming instruction books published in connection with sale of the machines referred to in the foregoing publications; U.S. Pat. Nos. 2,169,801, 2,697,336; and British Pat. Nos. 874,719 (which discloses a system to control the dial needles), and 996,291. Well-known parts of knitting machines are described in these references; the cooperation of the apparatus of the present invention with known parts and elements of knitting machines, and application of the invention to other machines and operating elements thereof, will be obvious.

I claim:

1. Circular knitting machine having a needle bed (1); needles (2, 21) located in the needle bed;

guide slots (4) guiding the needles for sliding movement in the needle bed;

a camming system (15, 16, 17; 34, 35, 36) having a first cam race to control protection of needles to a first projection position and a miss cam race to control needles to remain in miss position;

movable needle jacks (6, 22) slidable in said needle guide slots and being additionally pivotable about axes transverse to the sliding direction in the guide slots, the needle jacks being in engagement with the needles and the camming system, and having butts ($2^1$, $6^2$, $6^3$; 23) selectively engageable in the first cam race or in the miss cam race, the needle jacks associated with at least one of the cylinder or dial needles being located in the guide slots for rocking movement essentially in a plane of the guide slots;

jack control means (10, 32, 27, 30) controlling pivoting, rocking movement of the needle jacks to control selective engagement with a selected cam track;

means (7) locking the needle jacks in selected, rocked position as controlled by said jack control means, an second cam race formed in the camming system to control projection of the needles to a second projected position;

the locking means (7) having three selected locked positions for placement of the movable needle jacks in a selected one of said three pivoted positions, the butts being engageable with the additional cam race upon locking of the pivotable needle jacks to the second rocked, or pivoted position under command of said jack control means;

and wherein the locking means securing the needle jacks in selected position comprises a projecting end ($6^1$, 24) formed on the needle jack, said end being laterally, resiliently deflectable;

at least three groves formed in the machine adjacent said projecting end and located to be resiliently, selectively engaged by said projecting end to locate the same and permit longitudinal sliding movement of the jack while securing the jack against transverse shift while rocking.

2. Machine according to claim 1 wherein some of the needle jacks (6) have selector butts ($6^2$, $6^3$) located approximately equidistantly from a pivot point, and the first and second cam races (16, 17) are located opposite said pivot point for selective engagement by one of said selector butts to control projection of the jack, and hence the needle, in accordance with the cam track pattern of the cam race engaged by the selected butt.

3. Machine according to claim 1 wherein the needle jacks have a projecting selector butt (23) located on said jack at one side from a pivot point; l and the first and second cam races (31, 32) are of different depths and located to be engageable by said selector butt, selectively, in dependence on the extent of pivoting, and hence of projection of the butt to control projection of the jack, and hence the needle, in accordance with the pattern of the cam track of the cam race engaged by the butt.

4. Machine according to claim 1 wherein the first cam race controls the needle jack to project the needle to knitting position and the second cam race controls the needle jack to project the needle to tuck position.

5. Machine according to claim 1 wherein the first cam race controls the needle jack to project the needle to knitting position and the second cam race controls the needle jack to likewise project the needle to knitting position.

6. Machine according to claim 1 wherein the first and second cam races have camming elements which are selectively adjustable (18, 19) to provide a choice of cam track paths.

7. Machine according to claim 1 further comprising selector jacks (10) having high and low selector butts ($10^1$, $10^2$) and pattern means (32) selectively engaging said high and low butts.

8. Machine according to claim 2 wherein the needle jacks (22) are formed with an extending portion (24);

the jack control means comprises selector jacks (27) which are located beneath said extending portions;

and pattern means (30, $27^3$) are provided selectively engaging said selector jacks to move the selector jacks into selective engagement with the needle jacks and thus rock the needle jacks from below.

9. Machine according to claim 1 wherein the jack control means comprises selector jacks mounted for rocking movement, and the needle jacks (6) comprise a multi-component element (5, 6), one component (5) being coupled to the needle (2) to push the needle into selected position and the other component (6) being coupled to the associated selector jack (10) and movable by rocking about a plane substantially transverse to the sliding movement of the jack, and the needle, respectively in the machine.

10. Machine according to claim 1 comprising a connection arrangement between a respective needle jack (22) and a needle (21) and formed, respectively, on the respective needles and the jacks including a projecting component ($22^2$) having essentially, circular outline and a recessed component ($21^2$) of essentially circular outline into which the projecting component fits to permit both rocking movement of the respective needle jack and sliding movement longitudinally thereof and to form a fulcrum for pivoting, or rocking of the needle jack (24).

11. Machine according to claim 1, comprising a connection arrangement between a respective needle jack and a needle including an intermediate element 95) in engagement with the needle (2) to move the needle in sliding motion, the intermediate element (5) having one of the components of the connection arrangement formed thereon, to isolate rocking movement of the jack from the needle (25).

12. Machine according to claim 1, wherein elements beneath the needles (2,) are formed with shank ends (5,) facing the needle jacks (6,), the needle shanks and the element jacks at their facing end portions being formed with releasable, interengaging locking means to lock the needle shank ends and the element jacks in relatively locked alignment.

13. Machine according to claim 12, wherein the interengaging locking means comprises projection and recess means.

* * * * *